US005901598A

United States Patent [19]

Haar

[11] Patent Number: 5,901,598

[45] Date of Patent: May 11, 1999

[54] METHOD AND APPARATUS FOR EJECTING SHEET METAL PARTS FROM A PRESS

[75] Inventor: Thomas Haar, Halstenbek, Germany

[73] Assignee: Afon Haar Maschinenbau GmbH & Co., Hamburg, Germany

[21] Appl. No.: 08/863,054

[22] Filed: May 23, 1997

[30] Foreign Application Priority Data

May 30, 1996 [DE] Germany ..... 196 21 682

[51] Int. Cl.[6] ..... B21D 45/04

[52] U.S. Cl. ..... 72/345; 72/348

[58] Field of Search ..... 72/344, 345, 361, 72/463, 348

[56] References Cited

U.S. PATENT DOCUMENTS 4,571,978 2/1986 Taube et al. ..... 72/348
4,574,608 3/1986 Bulso, Jr. et al. ..... 72/348

FOREIGN PATENT DOCUMENTS 39 16 665 C2 11/1990 Germany .

*Primary Examiner*—Lowell A. Larson

*Attorney, Agent, or Firm*—Faegre & Benson LLP

[57] ABSTRACT

A method for ejecting sheet metal parts from a press, the press comprising a stationary core die portion and a movable punching die portion driven during a working stroke towards and during a return stroke away from the core die portion by driving means, a drawing member encircling the movable punching die portion, a circular or annular portion of said movable punching die portion being biased by spring means, ejection means associated with the press between the dead center of the strokes, the ejection being adapted to move a part laterally out of the travel path of the movable punching die portion by a laterally directed force. The method comprises the steps of punching and molding the parts by the cooperation of the movable punching die portion and the core die portion during a working stroke. A part is taken along with the movable punching die portion during the return stroke by a vacuum between the punching die portion and the part. The vacuum is built-up at the latest at the beginning of the return stroke. The vacuum is reduced after a given length of the return stroke such that the vacuum still exerts a suction force on the part at a position of the travel path where the ejection means is located, however, is safely overcome by the force of the ejection means.

13 Claims, 3 Drawing Sheets

METHOD AND APPARATUS FOR EJECTING SHEET METAL PARTS FROM A PRESS

The invention refers to a method and an apparatus for ejecting sheet metal parts from a press.

With a non-chipping forming of sheet metal parts, e.g. of lids, bottoms, covers or the like flat parts the cutting step wherein flat blanks are cut from a sheet panel is followed by a drawing step between a stationary die and a movable core die. Normally a drawing member encircles the forming surface of the movable die. Thus, the drawing takes places inside of the drawing member, with the material being held under tension by an annular holder. At the end of the drawing step the finally drawn metal sheet part is completely within the drawing member. Usually, movable die and drawing member are mounted to a ram which is actuated by the press, usually by a crank press.

The core die, however, is stationary. Such a die system has become known by the U.S. Pat. No. 4,574,608 or the German patent No. DE 39 16 665.

Due to the molded peripheral edges the molded sheet metal part is clampingly held inside the drawing member. For the ejection of the metal part it is necessary to push it out of the drawing member at a appropriate time. It is known to use an ejector actuated by a suitable power, e.g. either through a mechanical coupling with the ram of the press or by an pneumatic activation. Normally, this takes place during the return stroke of the ram. The metal part is pushed out of a drawing member and is moved laterally by suitable ejection means, e.g. a mechanical element or by an air flow.

The known method has a lot of disadvantages which increase with increasing frequency of the ram. Due to the necessarily controlled power the ejector inclusive its actuation mechanism has a considerable mass. Upon the opening of the dies, the ejector due to its high acceleration has the tendency to be displaced out of the drawing member in this phase so that the sheet metal part is ejected uncontrolled at an undesired instant. This can be obviated by corresponding spring forces. In any case, such a die mechanism is relatively expensive.

In the ejection phase occurring near the dead center after the return stroke or immediately prior to the dead center, respectively, the acceleration of the ram is negative. Thus, the ejection must take place against the relatively large spring force and against the oppositely directed acceleration of the ram. This results in a remarkable stress of the individual parts and in problems during the removal of the parts from the zone of the dies, in particular with high speeds of the ram. Expensive labor for the calibration for each specific part and a high ability to interference is the consequence.

Besides the above described controlled ejection system which has the goal to eject the metal part at a predetermined time during the return stroke of the ram other systems are known which are more simply structured. These provide a spring biased ejection ring which is part of the die mechanism. The ejection ring presses the metal part immediately from the drawing member after the opening of the dies. A controlled and directed removal of the sheet metal parts from the area of the die cannot be carried out with the described system. For this reason, the last mentioned ejection system usually is employed with inclined presses or in conjunction with expensive air flow systems. Despite of the use of an air flow the removal of the sheet metal parts is unsafe which is disadvantageous for facilities downstream of the press for the further processing of the metal parts. If for example can lids are to be rolled expensive buffering systems are to be provided or a plurality of parallel rolling devices.

The invention provides for a method for the ejection of sheet metal parts from the dies of a press which reduces the inventory for the dies and enables a controlled ejection at a predetermined position.

In the method according to the invention the sheet metal part is taken with the movable die during the return stroke by means of a vacuum which is built up between the metal part and the die at the latest with the start of the return stroke. In order to build up a vacuum it is required that the die inclusive the movable portion is sealed against atmosphere. An absolute sealing is not necessary. For the building up of the vacuum two possibilities can be selected. One consists in the measure to make use of the sub-pressure which results from the fact that the sheet metal part after termination of the drawing step is moved by the movable die portion of the die towards the stationary core die. This movement generates an enlargement of the volume behind the formed part and thus a sub-pressure provided this space formed such is not ventilated. The alternative is to generate a vacuum in the space, e.g. by a vacuum pump.

In the method according to the invention, the vacuum or sub-pressure is used to move the metal part over a predetermined travel path during return stroke into the area of the ejection means which move the metal part laterally from the die. This movement can take place by a mechanical element or through an air flow.

If the vacuum engaging the metal part is maintained the lateral movement may meet difficulties. According to the invention, the vacuum is reduced after a predetermined travel path of the return stroke such that the vacuum still exerts a suction force on the part at the location of the ejection means, however, can be safely overcome by the lateral force of said ejection means. Ideally, the metal part is suspended or floats with the die during the return stroke when being at the level of the ejection means without being considerably held tight. However, the holding forces which hold the metal part at the die do not solely depend upon the vacuum, rather also upon the speed of a ram and the point of time when the vacuum is approximately eliminated. If the individual selectable parameters are correctly adjusted a lateral ejection during the return stroke can take place at an arbitrary location. Appropriately, the ejection takes place half-way of the return stroke or to a slightly later point of time. Of course, the vacuum is reduced at an earlier moment. As known, the direction of the acceleration is changed half-way of the return stroke. Therefore, the acceleration is smaller prior to the return point. Thus, the forces to be generated by the vacuum can be smaller without affecting the carrying of the metal part. At the return point of the acceleration, the vacuum can be a minimum or zero if the ejection is to take place at this moment. During the further return stroke the acceleration is negative so that the inertia of the metal part has the tendency to hold it in engagement with the die.

The reduction of the vacuum can for example be carried out by a ventilation of the space between the metal part and the die, e.g. through a suitable communication to atmosphere. Alternatively, a blast pressure can be introduced into the space which eliminates the vacuum more or less instantly. This blast pressure, however, must not generate an excess pressure, otherwise undesired dynamic suction effects between the movable die part and the die may occur. Furthermore, the metal part may loose the adhesion to the movable die portion.

The cutting and molding tool preferred to carry out the method according to the invention preferably includes a passage which terminates at the molding surface of the die and is connected to atmosphere at the opposite end. This connection to atmosphere may be continuous. Provided the effective flow area is sized correspondingly, a subpressure can be generated by means of the movable die portion upon the movement of the sheet metal part. Thereafter, the vacuum is eliminated by allowing flow of air into the vacuum space. Since the ram moves with a considerable speed it is by no means possible to obtain the elimination of the vacuum at a point of time at which the lateral ejection is desired. A direct communication with atmosphere has the advantage that the excess of pressure occurring during the drawing step can be eliminated. Alternatively, the invention provides a valve in the passage which controls the flow area and is adapted to selectively shut off the passage or connected to atmosphere. Furthermore, a connection of the channel to a vacuum pump through the valve or to a pressure source is possible By means of the invention a sheet metal part adhered to the movable die portion can be presented relative to ejection means at a desired position of the die portion. The function of the invention is without failures, is steady and allows a safe reproduction. Calibration labor is not necessary. The structure of the die is considerably simplified. The invention allows to exactly eject the sheet metal parts also with high speeds of the ram so that also with a plurality of dies in the press the metal parts can be placed on a conveyor band in a series without any overlapping. Thus, the metal parts can be conveyed to a single facility for further processing steps. The number of machines for further processing steps can be reduced relative to conventional systems.

An embodiment example of the invention is subsequently described along accompanying drawings, wherein FIG. 1 shows a die arrangement during the pressing step to carry out the method according to the invention.

Figure 1:
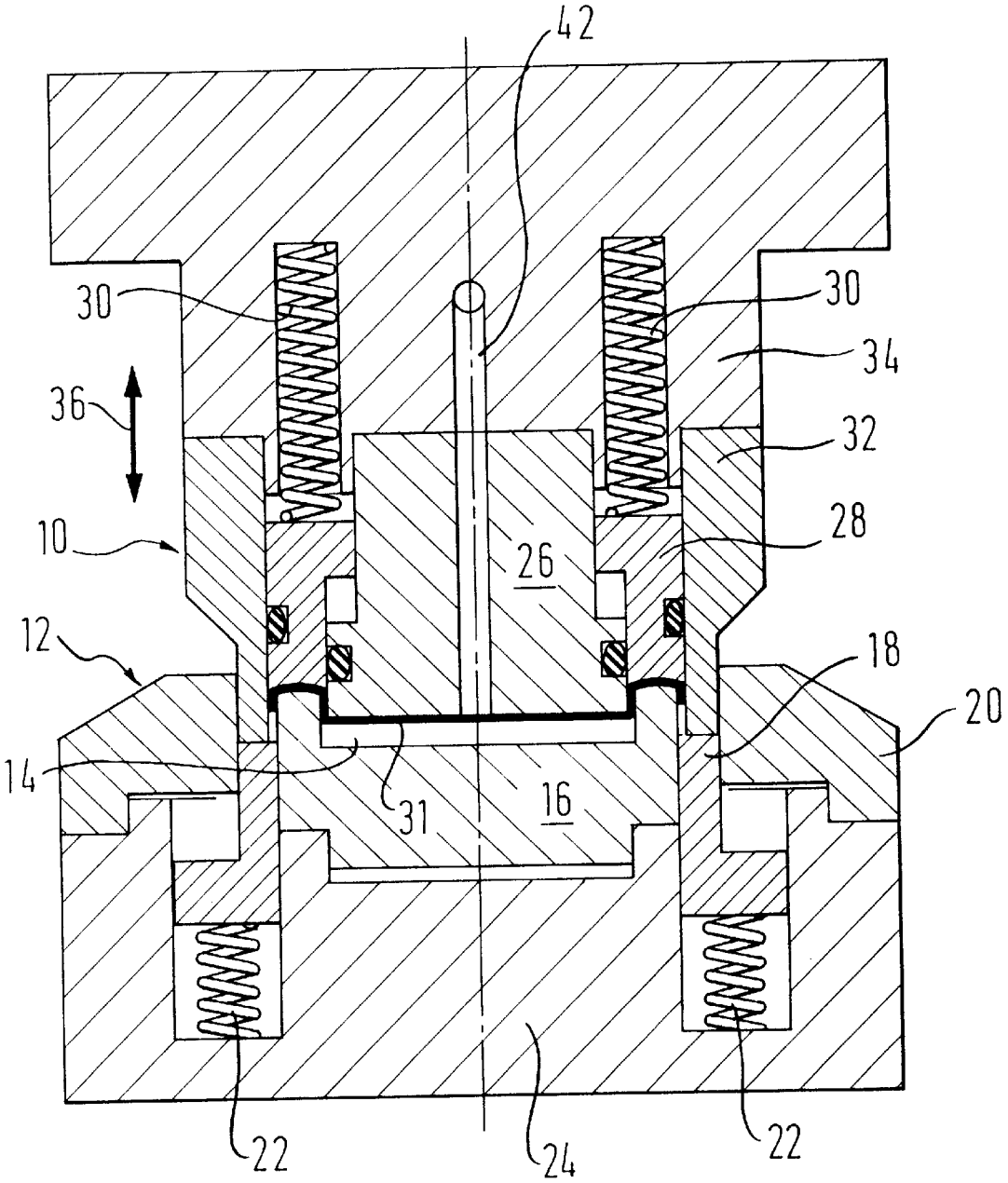

The die arrangement shown in FIG. 1 has an upper die 10 and a stationary drawing core 12. The latter has a circular portion 16 including a recess 14. The portion 16 is surrounded by an annular holder 18, and holder 18 is surrounded by an annular cutting tool 20. The holder 18 can be displaced downwardly against spring means 22. The parts described are supported by a support member 24 which in turn is fixedly attached to a stationary plate not shown.

The upper die 10 includes a circular inner portion 26 and an annular portion 28 surrounding the inner portion, the latter being axially movable relative to the first and is biased downwardly, i.e. towards core die 12 by means of springs 30 not described in detail. In FIG. 1 the lower dead center of the upper die 10 is shown wherein a lid 31 is formed having a plane center surface and a cambered flange-like margin is molded between the die parts. The die portion 28 is in a rejected position within its holding portion 32 which in turn is attached to a plate 34, e.g. by threaded fasteners not shown. Plate 34 can be attached to a ram of a crank press not shown. The upper parts shown in FIG. 1, thus move in the direction of double arrow 36, i.e. towards core 12 or away therefrom. It is understood that the parts shown in FIG. 1 can take an arbitrary position in the space.

The annular die portion 28 is surrounded by the annular drawing member 32 which is fixedly secured to plate 34.

Figure 2:
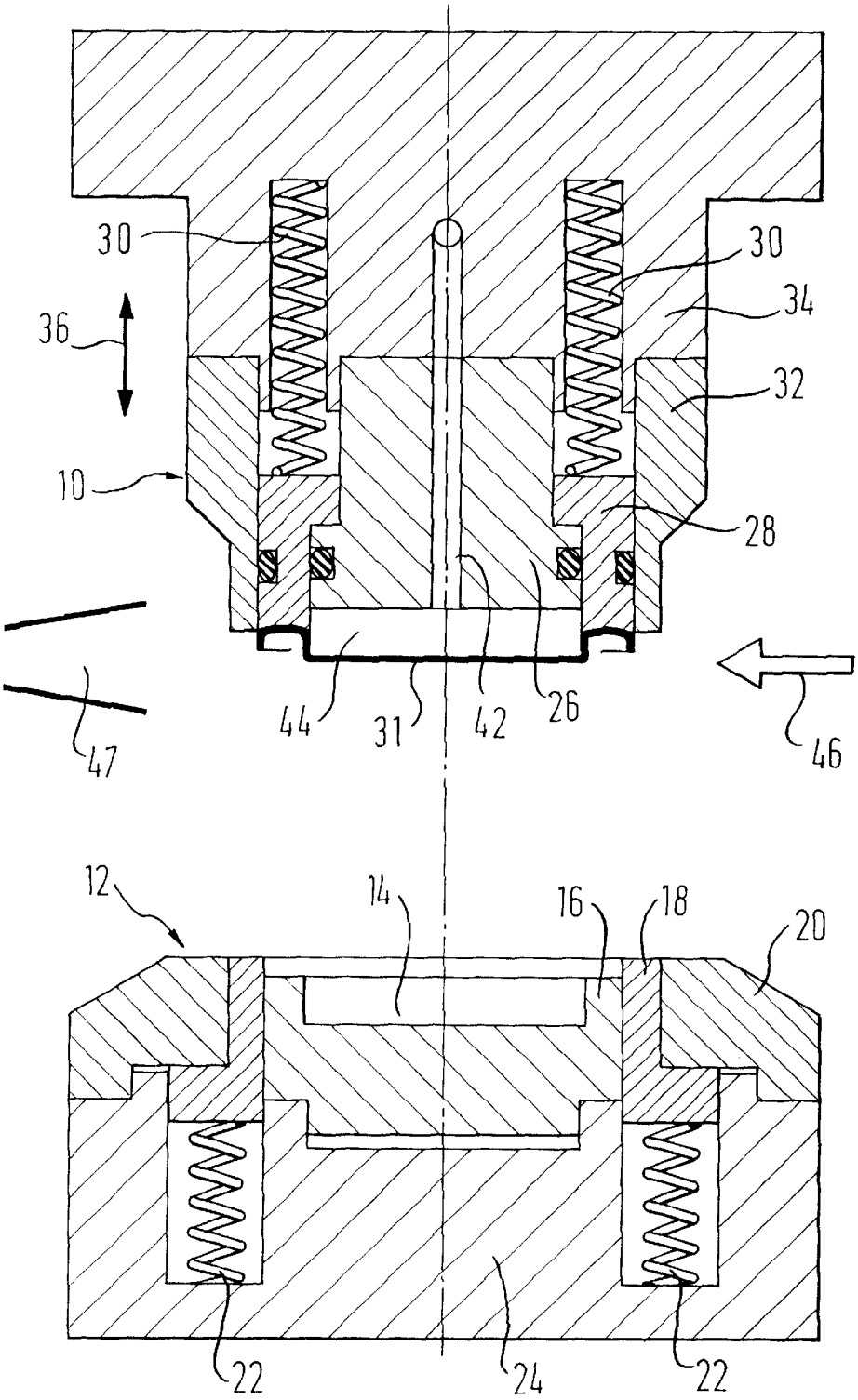
FIG. 2 shows the arrangement of FIG. 1 during the return stroke of the movable die.

The die arrangement illustrated by FIGS. 1 and 2 on principle is known. It is, however, essential and novel that the space below die 10 is in communication with a passage 42 which extends upwardly through die portion 26 into plate 34.

It can be seen in FIG. 1 how the die portions engage each other in order to cut out from a panel not shown and mold a part, e.g. a lid 31. The edge of the lid is within the annular recess which is formed by the inner die portion 26, the annular die portion 28 and the drawing member 32. As soon as the movable upper die is on its return stroke the annular die portion 28 presses the sheet metal part downwardly, with the metal part remains engaged with the annular die portion 23 through its molded flange and laterally with the drawing member 32 as can be seen in FIG. 2. Thus, the volume 44 between lid 31 and die portion 26 is enlarged which results in a sub-pressure provided it is not eliminated immediately by passage 42. With a corresponding size of the flow area of the passage 42 the reduction of the sub-pressure can be more or less accelerated so that the upper die 10 has moved away from the lower die a certain path until the sub-pressure is approximately zero. If this takes place at the level of arrow 46 the sheet metal part can be ejected laterally between the dies by a pulse-like air flow into the lateral channel 47. It is also possible to control the pressure within passage 42 in order to control the movement of the lid jointly with that of the upper die and to further control the elimination of the adhesion force. Such a control is indicated in FIG. 3.

Figure 3:
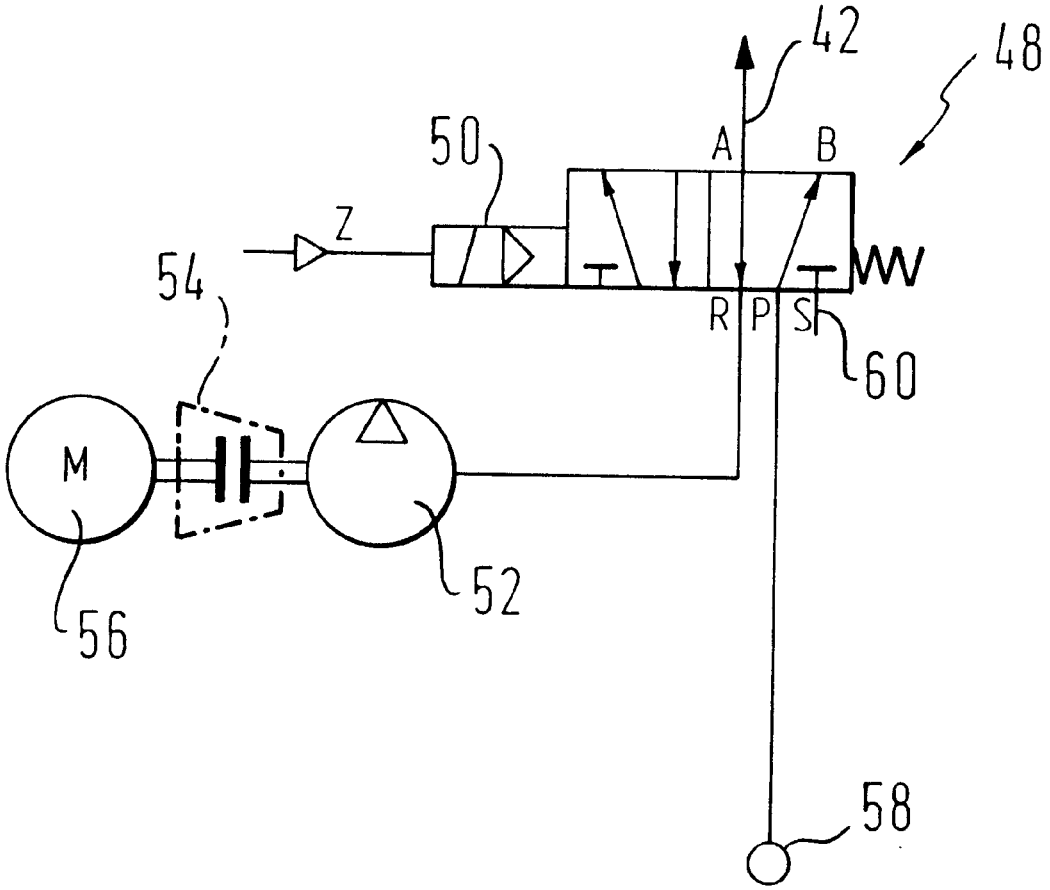
FIG. 3 shows diagrammatically a circuit for the operation of the die arrangement of FIGS. 1 and 2.

In FIG. 3 passage 42 is connected with the output of a valve arrangement 48. The valve arrangement 48 can be controlled as indicated at 50. The control can be an electrical or pneumatic one. An input R is connected to a vacuum pump 52 which through a clutch 54 is coupled to a driving motor 56. A further input P is connected with a pressure source 58. A third input S can be alternatively connected with atmosphere at 60.

The pressure condition in passage 42 can be controlled by a circuit of FIG. 3 in different manners. For example, a vacuum can be connected to passage 42 during the drawing step in order to eliminate the excess pressure which occurs behind lid 31 during the drawing step. Selectively, passage 42 can be connected to atmosphere during this step.

During the return stroke passage 42 can be connected to vacuum pump 52. At a desired moment, e.g. shortly prior to the return point for the acceleration or also thereafter the communication with vacuum pump 52 is shut off, and either a communication to atmosphere is established or alternatively pressure source 56 is connected to passage 42 a short time in order to eliminate the vacuum within a desired time interval.

In any case it is intended by means of the arrangement shown that the lid after being mold in the lower dead center is taken with the upper die during the return stroke up to the desired level where a lateral ejection force removes the metal part safely from the upper die.

The carrying of the metal part with the upper die takes place by a vacuum. Therefore, it is necessary that the spaces in the die above the lid are sealed against atmosphere as much as possible. A complete sealing is not necessary. At the moment when the sheet metal part is to be laterally removed the adhesive force to the annular die portion 28 should be as low as possible in order to achieve an easy lateral movement of the lid.

It is understood that valve 48 of FIG. 3 cannot establish all of the three described connections for passage 42 since it has only two switching positions. In case passage 42 is to be selectively connected with all three inputs, the control arrangement has to be enlarged. Finally, it is possible to connect the space above the lid through a further passage to atmosphere which, for example, includes a check valve in order to reduce an excess pressure during the molding process.

I claim:

1. A method for ejecting a sheet metal part out of a press, said press of the type having a stationary core die portion and a movable punching die portion driven during a working stroke towards and during a return stroke away from said core die portion by a driving means, a draw member encircling said moveable punching die, a portion of said punching die portion being biased by spring means towards said stationary core die portion, ejection means associated with said press between dead centers of said strokes, said ejection means being adapted to move said part laterally of a travel path of said movable punching die portion by a laterally directed force, the method comprising the steps of punching and molding said part by the cooperation of said movable punching die portion and said core die portion during said working stroke;

moving said spring biased portion of said movable punching die portion towards said stationary die portion at the beginning of said return stroke together with said sheet metal part such that a vacuum is built up between said sheet metal part, said spring biased die portion and the remainder of said movable punching die portion at least by the beginning of said return stroke;

carrying said part with said spring biased portion of said movable punching die portion during said return stroke by said vacuum;

reducing said vacuum after at least a portion of said return stroke such that forces on said part at a position of said travel path where said ejection means is located are such that they are overcome by said laterally directed force of said ejection means.

2. The method of claim 1, wherein the laterally directed ejection force is generated by an air flow at a predetermined location between said dead centers of said strokes of the said movable punching die portion.

3. The method of claim 2 wherein said space between said metal part and said movable punching die portion is ventilated for the reduction of the vacuum therein.

4. The method of claim 2 wherein for the reduction of said vacuum in said space between said movable punching die portion and said metal part, a blast pulse, which does not generate excess pressure in said space, is injected into said space.

5. The method of claim 1 wherein said space between said metal part and said movable punching die portion is ventilated for the reduction of the vacuum therein.

6. The method of claim 1 wherein for the reduction of said vacuum in said space between said movable punching die portion and said metal part, a blast pulse, which does not generate excess pressure in said space, is injected into said space.

7. An assembly for ejecting a sheet metal part out of a press comprising a punching and molding die portion movable towards and away from a stationary core die portion by a driving means and including a movable die portion which is biased towards said stationary core die portion by a spring means, and further including an ejection means adapted to move said part laterally of a travel path of said movable die portion by a laterally directed force wherein a passage is provided in said punching and molding die portion terminating at a molding surface of said punching and molding die portion and connectable to a vacuum source in order to establish a desired vacuum within said passage wherein a vacuum is built up between said sheet metal part, said spring means, and said movable die portion at least by the beginning of a return stroke such that said part is carried with the spring means during said return stroke by vacuum, and further wherein the vacuum is reduced after at least a portion of the return stroke such that a laterally directed force from the ejection means overcomes the vacuum.

8. The assembly of claim 7, wherein said passage has a defined effective flow area and is adapted to be connected to atmosphere.

9. The assembly of claim 8, wherein said effective flow area is changeable.

10. The assembly of claim 7, wherein a controllable valve is associated with said passage.

11. The assembly of claim 10, wherein said valve connects a vacuum source to said passage.

12. The assembly of claim 11, wherein the valve is selectably connectable to the vacuum source or to atmosphere.

13. The assembly of claim 7, wherein the pressure source is adapted to be connected to said passage through a controllable valve.

* * * * *